US006551502B1

(12) United States Patent
Lee et al.

(10) Patent No.: US 6,551,502 B1
(45) Date of Patent: Apr. 22, 2003

(54) PROCESS OF REMOVING SULFUR COMPOUNDS FROM GASOLINE

(75) Inventors: Fu-Ming Lee, Katy, TX (US); Joseph C. Gentry, Houston, TX (US); Randi Wright Wytcherley, Belgrade, MT (US); Lucia Cretoiu, Houston, TX (US); Calambur Shyamkumar, Houston, TX (US)

(73) Assignee: GTC Technology Corporation, Houston, TX (US)

( * ) Notice: Subject to any disclaimer, the term of this patent is extended or adjusted under 35 U.S.C. 154(b) by 24 days.

(21) Appl. No.: 09/686,889

(22) Filed: Oct. 12, 2000

Related U.S. Application Data

(60) Provisional application No. 60/182,022, filed on Feb. 11, 2000.

(51) Int. Cl.[7] ..... C10G 45/00

(52) U.S. Cl. ..... 208/211; 208/218; 208/87; 208/89; 203/53; 203/57; 203/63

(58) Field of Search ..... 208/211, 218, 208/87, 89; 203/53, 57, 63

(56) References Cited

U.S. PATENT DOCUMENTS

| | | | | |
|---|---|---|---|---|
| 2,285,696 A | | 6/1942 | Dunn | 208/211 |
| 2,455,803 A | | 12/1948 | Pierotti | 203/51 |
| 2,634,230 A | | 4/1953 | Arnold et al. | 208/211 |
| 2,849,514 A | * | 8/1958 | Nevitt | 585/856 |
| 3,338,824 A | | 8/1967 | Oliver | 208/313 |
| 3,470,088 A | * | 9/1969 | Vickers | 208/321 |
| 3,472,909 A | * | 10/1969 | Raymond | 585/251 |
| 3,640,818 A | * | 2/1972 | Hamner | 208/65 |
| 4,035,285 A | * | 7/1977 | Owen et al. | 208/120 |
| 4,053,369 A | | 10/1977 | Cines | 203/52 |
| 4,097,371 A | * | 6/1978 | Giroux | 208/313 |
| 5,360,532 A | | 11/1994 | Fletcher et al. | 208/89 |
| 5,582,714 A | | 12/1996 | Forte | 208/237 |
| 5,849,982 A | * | 12/1998 | Lee et al. | 585/833 |
| 6,124,514 A | * | 9/2000 | Emmrich et al. | 585/261 |
| 6,228,254 B1 | * | 5/2001 | Jossens et al. | 208/212 |
| 6,358,402 B1 | | 3/2002 | Schucker | 208/237 |

OTHER PUBLICATIONS

Fu–Ming Lee, "Use of Organic Sulfones as the Extractive Distillation Solvent for Aromatics Recovery", Ind. Eng. Chem. Process Des. Dev., vol. 25, No. 4, 1986, pp. 949–957. No date.

Fu–Ming Lee, et al., "Two–Liquid–Phase Extractive Distillation for Upgrading the Octane Number of the Catalytically Cracked Gasoline", Ind. Eng. Chem. Res., vol. 27, No. 1, 1988, pp. 118–123.

* cited by examiner

*Primary Examiner*—Nadine G. Norton
(74) *Attorney, Agent, or Firm*—Fitzpatrick, Cella, Harper & Scinto

(57) ABSTRACT

A process for the removal of sulfur compounds from a hydrocarbon stream is disclosed. In a preferred embodiment, the process includes extractive distillation of a gasoline stream from a fluid catalytic cracker to reject olefins to a raffinate stream and simultaneously extract sulfur compounds to an extract stream.

19 Claims, 2 Drawing Sheets

PROCESS OF REMOVING SULFUR COMPOUNDS FROM GASOLINE

This application claims priority to U.S. Provisional Application No. 60/182,022, filed Feb. 11, 2000 and herein incorporated by reference in its entirety.

BACKGROUND OF THE INVENTION

1. Field of the Invention

The invention relates to hydrocarbon refining, and more particularly to a process for removing sulfur compounds from gasoline.

2. Description of the Related Art

The major source of gasoline sulfur (up to 98%) is from the gasoline produced from fluid catalytic cracking (FCC), which comprises 30 to 70% of the gasoline pool. One of the most effective ways to remove the sulfur from gasoline is to hydrotreat the FCC gasoline. However, this stream contains significant amounts of olefinic compounds, and hydrotreating these compounds substantially reduces the octane rating of the blended gasoline.

The typical current approach is to fractionate the FCC gasoline into a light fraction containing non-thiophene type sulfur compounds and hydrocarbons boiling below the boiling point of thiophene (84° C.), and a heavy fraction containing all the thiophene-type sulfur compounds and heavier hydrocarbons. The light fraction is then treated in a caustic washing unit (such as a Merox unit) to remove the non-thiophene type of sulfurs. The heavy fraction is fed to a hydrodesulfurization (HDS) unit to eliminate the thiophene type of sulfurs. All olefins which have boiling points higher than thiophene are subject to HDS treatment, resulting in a reduction of octane rating.

U.S. Pat. No. 4,053,369 discloses a two-liquid phase extractive distillation process for the separation of aromatics and non-aromatics which extracts sulfur compounds in the process. However, the disclosure of the above patent is limited to extractive distillation operated with 2 liquid phases in the extractive distillation column.

SUMMARY OF THE INVENTION

This invention is related to the incorporation of an extractive process into refining processes to simultaneously extract sulfur compounds and reject olefinic compounds in the hydrocarbon streams. Particularly preferred streams for use with the invention are derived from, for example, a coker naphtha source, a thermal steam cracked source or a fluid catalytic cracker (FCC) unit. Gasoline from a FCC unit is particularly preferred for use with the invention.

The gasoline stream may comprise single and multi-ring aromatics, single and multi-ring naphthenes, olefins, paraffins, thiophenes, benzothiophenes, sulfides, disulfides, thiols, tetrahydrothiophenes, and dihydrobenzothiophenes, having boiling points ranging from about 50° C. to about 250° C.

Preferably, a prefractionation column is used to remove benzothiophenes and high molecular weight sulfur compounds from said gasoline stream, and the boiling points of the gasoline stream range between about 50° C. and about 220° C.

According to the invention, only the extract stream with the sulfur concentrates is hydrodesulfurized with a conventional or improved HDS (hydrodesulfurization) unit. In this way, the octane rating of the desulfurized FCC gasoline can be preserved, since the olefinic compounds with higher octane rating are rejected by the extractive process from the stream, which is treated in the HDS unit.

A process to remove sulfur compounds from a gasoline stream containing olefins and sulfur compounds according to the invention comprises subjecting a gasoline stream to an extractive process to concentrate the sulfur compounds in an extract stream and reject olefins to a raffinate stream, and subjecting only said extract stream to hydrodesulfurization to remove sulfur compounds.

In particularly preferred embodiments the process according to the invention comprises an extractive distillation process conducted in an extractive distillation column substantially without a two-liquid phase region.

The selection of the operating parameters of an extractive distillation column, including the appropriate pressures, temperatures, reflux ratios, and solvents used, to avoid a two-phase region is within the skill of the ordinary artisan.

DETAILED DESCRIPTION OF THE PREFERRED EMBODIMENTS

Extractive processes within the scope of the invention include extractive distillation (ED) or liquid-liquid extraction (LLE). A schematic diagram of one of the embodiments is presented in FIG. 1. The full range of the FCC gasoline is fed to an extractive process where a proper extractive solvent or mixed solvent is used to extract the sulfur compounds and aromatics into an extract stream. At the same time, olefinic, naphthenic, and paraffinic compounds in the gasoline stream are rejected by the solvent into a raffinate stream. The sulfur compounds include mainly mercaptans, sulfides, disulfides, thiophenes, benzothiophenes and dibenzothiophenes. The extract stream (with sulfur concentrates) is then fed to an HDS unit for sulfur removal. The desulfurized extract stream can be recombined with the raffinate stream for gasoline blending or routed to an aromatics recovery unit to purify the benzene, toluene and xylenes. The preferred process is extractive distillation, due to its higher efficiency for extracting all the sulfur compounds and rejecting olefins in the FCC gasoline as compared with the liquid-liquid extraction process, using the same solvent. Since the raffinate (overhead) stream from the ED column contains only a minor amount of sulfurs (mainly non-thiophene type), caustic washing (a Merox unit) is not required. This is one of the major advantages of this technology.

Another advantage of this invention is that the extract stream from the ED process contains 60 to 90% aromatics. This stream can optionally be fed to the second-stage hydrotreater and aromatic extraction unit of an ethylene plant, or, after hydrodesulfurization, to a reformate extraction unit to recover benzene or full-range aromatics.

Figure 1:
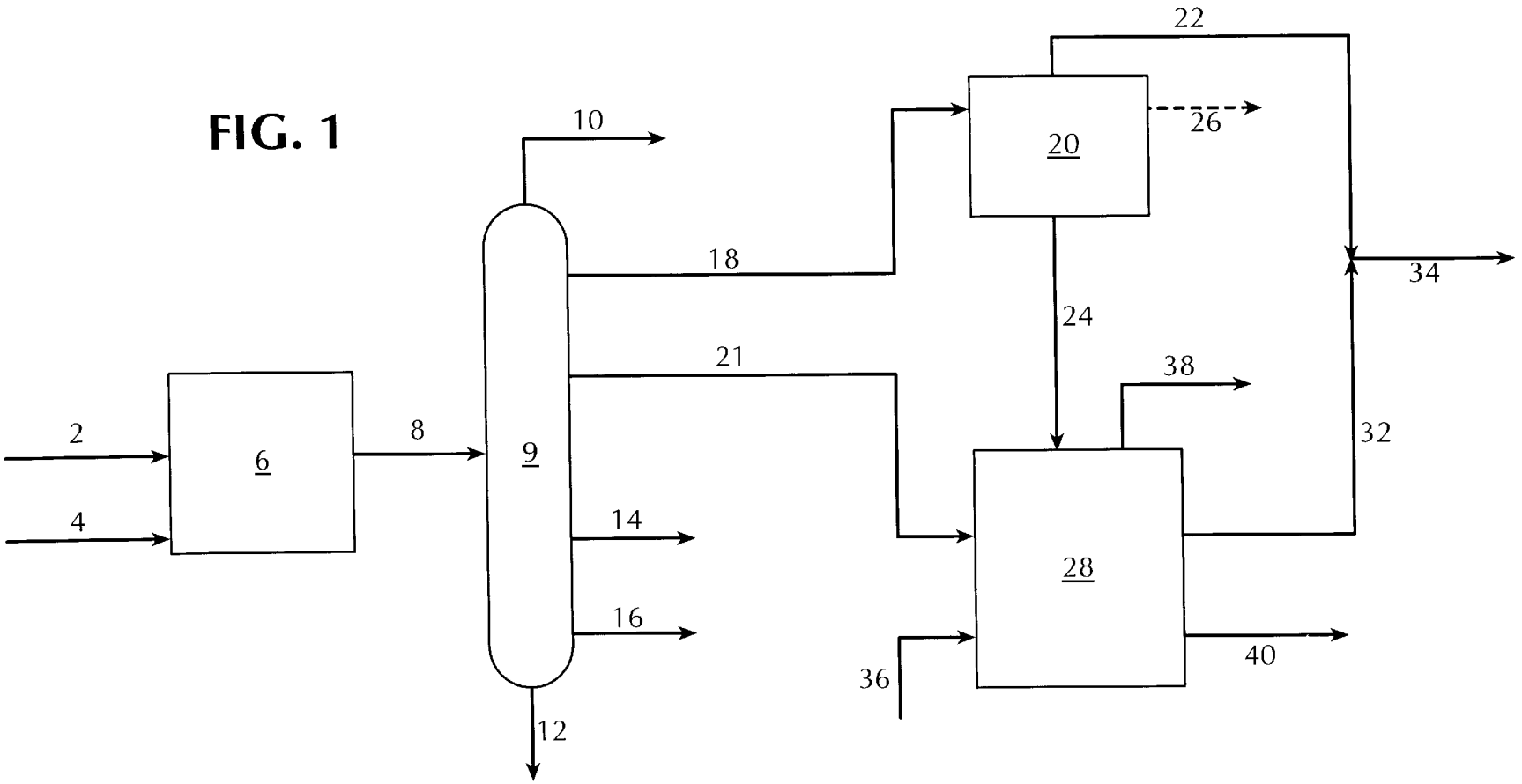
FIG. 1 depicts a process incorporating gasoline desulfurization according to an embodiment of the invention.

Referring to a generalized embodiment depicted schematically in FIG. 1, heavy gas oil feed 2 and residue flasher tops 4 are fed to fluid catalytic cracking unit 6. A line 8 from the fluid catalytic cracking unit 6 feeds catalytic cracker fractionator 9. The light product of the catalytic cracker fractionator, including catalytic cracker gas 10, may be removed from the top, and heavy cycle oil 12, removed at the bottom; other fractions, such as light cycle oil 14 and heavy gas oil 16, may be removed for further processing and/or recycling. Light naphtha fraction 18 is fed to an extractive process unit 20 (for example a liquid-liquid extraction or extractive distillation column) while heavy naphtha fraction 21 is fed to the hydro-treating unit 28. Extractive unit 20 produces desulfurized light naphtha raffinate stream 22 and a bottom extract stream 24 containing sulfur compounds and aromatics. An optional benzene or benzene concentrate stream may be taken at 26. Pursuant to the invention, only the bottom extract stream 24 from the extractive process unit 20 is treated in hydro-treating unit 28. Desulfurized light naphtha gasoline raffinate stream 22 of the extractive unit 20 and desulfurized heavy naphtha 32 from the hydrotreating unit 28 may be combined to make product stream 34. The raffinate stream may be recycled to the fluid catalytic cracking reactor, or to a unit that converts the olefins into lower molecular weight olefins, such as $C_2$–$C_6$ olefins. Hydrogen is added to the hydrotreating unit 28. Besides desulfurized heavy naphtha 32, hydrotreating unit 28 produces lights 38 and hydrogen sulfide ($H_2S$) 40 which may be further treated in a Claus unit (not shown). Fractionator 9 is sometimes referred to herein as a "prefractionator column." The light fraction fed to the extractive process 20 from the prefractionator column is sometimes referred to herein as an "overhead stream," and a heavy fraction forwarded to the hydrotreating unit is sometimes referred to as a "bottom stream."

Contrary to the suggestion contained in U.S. Pat. No. 4,053,369, the inventors herein have found that a two-liquid phase region should preferably be avoided in the extractive distillation according to the invention, since it reduces the solvent performance in the ED column.

To illustrate this point, experiments were carried out in a one-stage ED unit, where antisolvent (water) was added to the solvent (sulfolane) to ensure or expand a second liquid phase in the mixture. Three portions of ED solvent were mixed in the ED unit with one portion of feed liquid containing 34.4 wt % of n-hexane, 32.9 wt % of 1-hexene, 32.4 wt % benzene, and 0.21 wt % thiophene. The mixture was heated up to its boiling point at a pressure of approximately 645 mm Hg under total reflux. The equilibrium vapor phases are summarized in Table 1.

TABLE 1

| Composition | No Solvent | Sulfolane | Sulfolane +5% Water |
|---|---|---|---|
| n-hexane | 36.1 | 45.1 | 44.8 |
| 1-hexane | 37.9 | 43.0 | 42.5 |
| benzene | 25.8 | 11.9 | 13.5 |
| thiophene | 0.17 | 0.06 | 0.08 |

From Table 1, sulfolane with 5% water (an example of an expanded two-liquid phase extractive distillation) shows higher vapor composition of benzene and thiophene and lower vapor composition of 1-hexene than were obtained with sulfolane alone as the solvent. This demonstrates that the presence of a two-liquid phase region in the ED unit causes the solvent to extract less thiophene and more 1-hexene. In other words, less sulfur-containing compound is extracted, and less olefin is rejected using a two-liquid phase system. The two liquid phase solvent also extracted less benzene (aromatics). Therefore, two-liquid phases in the ED unit produced no benefit in terms of sulfur extraction and olefin rejection at all. In fact, it should be avoided or minimized in this application.

The inventors herein used data previously published (F. M. Lee, Ind. Eng. Chem. Process Dos. Dev., Vol. 25, No. 4, 1986, pp. 949–57, incorporated herein by reference in its entirety) to show that the presence of a two-liquid phase region has a negative impact on ED performance in desulfurization of gasoline.

Two solvents were chosen for the comparison: di-n-propyl sulfone (DPS) which has high solubility for hydrocarbons and forms a single-liquid phase at the solvent-to-feed ratios (S/F) from 2.0 to 8.0; and sulfolane (SULF) which has lower solubility for hydrocarbons and tends to form two liquid phases at low S/F. Some of the experimental data from a one-stage ED unit are presented in Tables 2 and 3.

TABLE 2

| Solvent | S/F | n-$C_7$in liq. (wt %) | n-$C_7$ in vap. (wt %) | $\alpha$ | Liq. Phases |
|---|---|---|---|---|---|
| (no solvent) | 0 | 50.22 | 57.03 | 1.32 | 1 |
| DPS | 2.0 | 50.45 | 72.57 | 2.60 | 1 |
| SULF | 2.0 | 50.23 | 67.55 | 2.06 | 2 |
| DPS | 3.0 | 50.45 | 74.33 | 2.84 | 1 |
| SULF | 3.0 | 50.45 | 73.80 | 2.77 | 2 |
| DPS | 4.0 | 50.45 | 78.18 | 3.52 | 1 |
| SULF | 4.0 | 50.38 | 75.22 | 2.99 | 2 |

Notes:
1. Hydrocarbon feed was an n-heptane and toluene mixture.
2. Both DPF and SULF solvents contained 4.0 wt % water.
3. $\alpha$ is the relative volatility of n-heptane over toluene; $\alpha = (Y_1X_2)/(Y_2X_1)$ where $Y_1$ and $Y_2$ are the vapor composition of the components 1 and 2, respectively; $X_1$ and $X_2$ are the liquid compositions.

TABLE 3

| Solvent | $H_2O$ | n-$C_7$in lig. (wt %) | n-$C_7$ in vap. (wt %) | $\alpha$ | Lig. Phases |
|---|---|---|---|---|---|
| DPS | 0 | 30.49 | 58.23 | 3.18 | 1 |
| SULF | 0 | 30.45 | 72.64 | 6.06 | 1 |
| DPS | 2.0 | 30.49 | 56.18 | 2.92 | 1 |
| SULF | 2.0 | 30.45 | 72.85 | 6.13 | 1 |
| DPS | 4.0 | 30.49 | 58.55 | 3.22 | 1 |
| SULF | 4.0 | 30.45 | 72.90 | 6.14 | 1 |

Notes:
1. S/F = 8.0
2. $H_2O$ is the wt % of water in the solvent
3. Hydrocarbon feed was an n-heptane and toluene mixture.
4. $\alpha$ is the relative volatility of n-heptane over toluene; $\alpha = (Y_1X_2)/(Y_2X_1)$ where $Y_1$ and $Y_2$ are the vapor composition of the components 1 and 2, respectively; $X_1$ and $X_2$ are the liquid compositions.

As shown in Table 2, DPS demonstrated a better performance (higher $\alpha$ values) than SULF under the same experimental conditions, where the mixture with SULF had two-liquid phase (at S/F=2.0 to 4.0) due to lower solubility of SULF than DPS. However, the data in Table 3 showed that SULF has much higher selectivity than DPS when both solvents were under single-liquid phase condition at a high S/F (S/F=8.0). These data clearly indicate that two-liquid phase operation is detrimental to the selectivity of the ED solvents and the performance of the process, and should be avoided whenever possible.

Based on the above experimental demonstration, we prefer to select ED solvents, which will provide single-liquid phase in the ED column of for extracting sulfur and rejecting olefins in the FCC gasoline. Also, the boiling point of the ED solvents should be high enough to be recovered in the solvent stripper and not to contaminate the extracted products. The non-limiting solvent examples include sulfolane, 3-methylsulfolane, 2,4-dimethylsulfolane, 3-ethylsulfolane, N-methyl pyrrolidone, 2-pyrrolidone, N-ethyl pyrrolidone, N-propyl pyrrolidone, N-formyl morpholine, dimethylsulfone, diethylsulfone, methylethylsulfone, dipropylsulfone, dibutylsulfone, tetraethylene glycol, triethylene glycol, dimethylene glycol, ethylene glycol, ethylene carbonate, propylene carbonate, and mixtures thereof. The presently preferred solvents are sulfolane, 3-methylsulfolane, N-formyl morpholine, 2-pyrrolidone, dipropylsulfone, tetraethylene glycol, and mixtures thereof.

In the process according to an embodiment of the invention, the extractive distillation solvent includes a co-solvent. For example, a preferred solvent comprises sulfolane with 3-methylsulfolane, N-formyl morpholine, 2-pyrrolidone, dipropylsulfone, tetraethylene glycol, water, heavy sulfur residuals from FCC gasoline, or mixtures thereof as a co-solvent.

FCC gasoline contains many different types of sulfur species, including, without limitation, mercaptans, sulfides, disulfides, thiophenes, and benzothiophenes. The heavy sulfur species, mainly benzothiophenes, have been shown previously to enhance the solvent selectivity. See, for example, F. M. Lee & D. M. Coombs, Ind. Eng. Chem. Res., Vol. 27, No. 1, 1988, pp. 118–23, incorporated herein by reference.

An experiment was conducted in a one-stage ED unit using sulfolane and sulfolane containing heavy residual sulfurs from FCC gasoline as the solvents. The hydrocarbon feed was 30 wt % n-heptane and 70 wt % toluene at a S/F of 3.0. Some of the experimental data are presented in Table 4.

TABLE 4

| Solvent System | Wt % $H_2O$ in Solvent | n-$C_7$in Vapor. (wt %) | Tolulene in vapor (wt %) | α |
|---|---|---|---|---|
| Sulfolane | 1.0 | 64.7 | 35.3 | 4.27 |
| | 2.0 | 64.5 | 35.5 | 4.24 |
| | 3.0 | 64.0 | 36.0 | 4.15 |
| | 4.0 | 62.6 | 37.4 | 3.91 |
| Sufolane | 1.0 | 65.9 | 34.1 | 4.51 |
| with Heavy | 2.0 | 65.2 | 34.8 | 4.37 |
| Residual | 3.0 | 65.0 | 35.0 | 4.33 |
| Sulfurs | 4.0 | 64.2 | 35.8 | 4.18 |

Based on the α values (solvent selectivity) in Table 4, it is obvious that the heavy residual sulfur compounds improved the performance of sulfolane solvent in the ED unit. Thus, an aspect of the invention is the inclusion of heavy residual sulfur compounds in the extractive distillation solvent to improve selectivity.

Since the heavier sulfur species, such as benzothiophene have stronger bonding with the ED solvents than hydrocarbons having similar boiling points, these heavier species tend to stay in the lean ED solvent after the hydrocarbons are stripped from the solvent. This makes it easier to control the amount of sulfur in the lean ED solvent by adjusting the operating conditions of the solvent stripper. To prove this point, we mixed 1.7 wt % benzothiophene and 98.3 wt % sulfolane in a one-stage ED unit and heated the mixture to 180° C. under 370 mm Hg pressure (anticipated solvent stripper temperature). Benzothiophene concentration dropped to 1.17 wt % after 85 minutes, to 1.10 wt % after 146 minutes, and to 0.82 wt % after 326 minutes. Heavier sulfur compounds will have even stronger bonding with the solvent than benzothiophene.

To prevent accumulation of heavy sulfurs and hydrocarbons in the lean solvent, a slip stream of the lean solvent is water-extracted to remove the solvent, leaving heavy sulfurs and hydrocarbons behind. To demonstrate this concept, a one-stage extraction test was performed by contacting one portion of the mixture containing 84% sulfolane and 16% benzothiophene with 20 portions of water at 50° C. After a one-stage extraction, the aqueous phase contained 99% sulfolane (the solvent) and 1% benzothiophene, while the organic phase contained 6% sulfolane and 94% benzothiophene. We expect the components can be completely separated using a few more extraction stages. The inventors have also found that both heavy sulfurs and hydrocarbons are insoluble in water even after 6-stage water extraction. The aqueous phase can be recycled to the solvent stripper to recover the solvent and provide a small amount of stripping steam.

The following examples demonstrate the effectiveness of the inventive ED process for extracting the sulfur components and rejecting olefin components in the FCC gasoline.

EXAMPLES

Example 1

The experiment was conducted in a one-stage ED unit. In this study, we used benzene (B), 1-hexene (1-H), n-hexane (n-H), thiophene (TH), methyl propanethiol (MP), and ethylmethyl sulfide (EMS), to represent, respectively, aromatics, olefins, paraffins, thiophenes, mercaptans, and sulfides. The mixture was fed to the ED unit and heated to its bubble point under total reflux. After the vapor and liquid equilibrium was achieved, samples were withdrawn from both the liquid and vapor phases for analysis. Then, sulfolane was added to the mixture in the ED unit at a solvent-to-feed ratio (S/F) of 3.0 and the new mixture was heated to the bubble point again before sampling. The experimental results are summarized in Table 5:

TABLE 5

Overhead (Raffinate) Composition of the ED Unit

| | |
|---|---|
| Hydrocarbon feed compositions: | 32.53 wt % benzene(B), 38.52 wt % n-hexane (n-H), 28.68 wt % 1-hexene (1-H), 0.083 wt % methyl propanethiol (MP), 0.110 wt % ethyl methyl sulfide (EMS), and 0.073 wt % thiophene (TH). |
| Solvent: | Sulfolane |
| Pressure: | 640 mm Hg |
| Temperature: | 62.1° C. |

| Composition (wt %) | S/F | B | n-H | 1-H | MP | EMS | TH |
|---|---|---|---|---|---|---|---|
| No Solvent | 0 | 26.91 | 39.80 | 33.05 | 0.058 | 0.133 | 0.059 |
| Sulfolane | 3.0 | 12.07 | 50.02 | 37.77 | 0.044 | 0.081 | 0.023 |
| (S/F = 3.0)/No Solvent | | 0.45 | 1.26 | 1.14 | 0.76 | 0.61 | 0.39 |

The compositions shown in the Table 5 are the overhead (raffinate) compositions, so the lower the value, the better the solvent extraction. The values of the concentrations of all the sulfur species at S/F of 3.0 are significantly lower than the values obtained under the "no-solvent" condition. To express the affinity of the solvent for the sulfur species quantitatively, the ratio of the respective concentration values at S/F of 3.0 to the corresponding values at no solvent is given in the bottom row of Table 5. As shown in Table 5, these ratios for the sulfur-containing compounds are all well below 1.00, which means the solvent extracts all types of sulfur species in the ED unit. Therefore, we rank the affinity of the solvent to the sulfur compounds in the following sequence: Thiophene (0.39)>Ethyl methyl sulfide (0.61) >Methyl propanethiol (0.76).

Thus all types of sulfur compounds can be completely extracted to the bottoms of an ED column with reasonable theoretical stages. Of course, a certain amount of sulfur is allowed in the overhead stream from the ED column for gasoline blending without the treatment of caustic washing.

For 1-hexene as well as n-hexane, the ratios were both significantly greater than 1.00, which indicates that the solvent enhances the rejection of both compounds compared to the distillation without solvent.

Example 2

Actual FCC gasoline was used as the feedstock for this example. The composition of the FCC gasoline is given in Table 6.

TABLE 6

| Component | Wt % | Simulated Distillation - D2887 | |
|---|---|---|---|
| Paraffins | 4.84 | %-off IBP | 21.4° C. |
| Isoparaffins | 30.48 | 5 | 39.6 |
| Olefins | 26.95 | 10 | 53.5 |
| Naphthenes | 11.75 | 15 | 56.9 |
| Aromatics | 24.62 | 20 | 62.1 |
| Unknown | 1.37 | 25 | 69.4 |
| | | 30 | 72.2 |
| | ppm | 35 | 78.6 |
| | | 40 | 85.7 |
| Light sulfur gases | 5 | 45 | 90.4 |
| Thiols | 59 | 50 | 98.6 |
| Sulfides | 8 | 55 | 105.6 |
| Thiophenes | 584 | 60 | 111.4 |
| Tetrahydrothiophenes | 70 | 65 | 114.8 |
| benzothiophenes | 216 | 70 | 124.9 |
| Dihydrobenzothiophenes | 12 | 75 | 137.4 |
| Disulfides | 1 | 80 | 139.7 |
| | | 85 | 145.7 |
| | | 90 | 163.2 |
| | | 95 | 181.3 |
| | | FBP | 220.6 |

The FCC gasoline with the properties shown in Table 6 was fed to a one-stage ED unit along with sulfolane containing 0.5 wt % water as the ED solvent at a S/F of 3.0. The unit was then heated to the boiling point (70° C.) under 638 mm Hg pressure in total reflux. After the vapor-liquid equilibrium was achieved, both vapor and liquid phases were sampled for analysis. Results of the analysis are summarized in Table 7.

TABLE 7

| | Sulfur (ppm) | Paraffins (vol %) | Isoparaffins (vol %) | Olefins (vol %) | Naphthenes (vol %) | Aromatics (vol %) |
|---|---|---|---|---|---|---|
| Feed | 923 | 5.52 | 30.10 | 29.99 | 11.42 | 22.97 |
| Raffinate | 84 | 6.97 | 42.17 | 43.94 | 5.41 | 1.51 |
| Raffinate/Feed | 0.09 | 1.26 | 1.40 | 1.47 | 0.47 | 0.07 |

As shown in Table 7, with a 3.0 solvent-to-feed ratio, more than 90% of the sulfur was extracted by the solvent (from 923 ppm in the feed to 84 ppm in the raffinate) in a one-stage ED unit. The solvent simultaneously rejected olefins, as well as paraffins and isoparaffins, to the raffinate stream. As expected, aromatics were substantially extracted by the solvent.

Example 3

An ED process simulation and design were carried out according to the following conditions:

| | |
|---|---|
| ED solvent | Sulfolane |
| Co-solvent | Water: 0.1–1.0 wt % |
| Solvent to Feed ratio: | 3.3–3.7 (wt.) |
| Extractive Distillation column: | |
| Top pressure: | 1.5–1.7 Kg/cm$^2$ |
| Theoretical stages: | 30–35 |
| Reflux ratio: | 0.2–0.5 |
| Solvent Recovery Column: | |
| Top Pressure: | 0.3–0.7 Kg/cm2 |
| Theoretical stages: | 18–22 |
| Reflux ratio: | 0.3–0.5 |
| Stripping Steam/HC. | 0.1–0.4 (wt.) |

Figure 2:
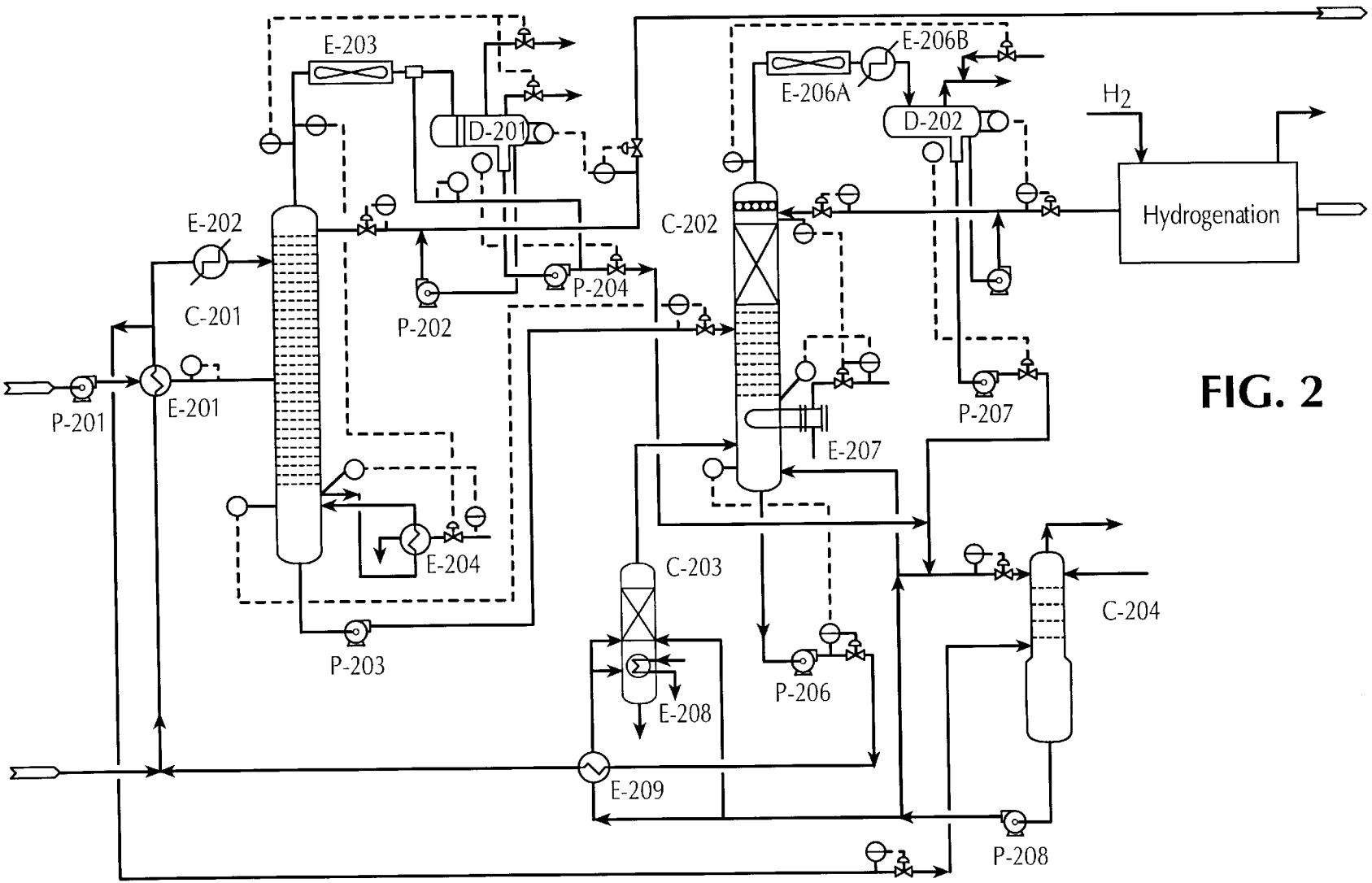
FIG. 2 is a process flow diagram of a process incorporating gasoline desulfurization according to an embodiment of the invention.

The process flow diagram is shown in FIG. 2. FCC gasoline with the composition given in Table 6 is preheated in E-201 and fed into the middle part of the ED column C-201. Lean solvent cooled in E-202 is fed to the top of the column. In a vapor-liquid operation, the solvent will extract the sulfur compounds into the bottoms of the column along with the aromatic components, while rejecting the olefins and saturates into the overhead as raffinate. The column overhead vapor is condensed in E-203 and a portion of this stream is recycled back to the column as reflux, with the remaining raffinate sent to gasoline blending tank. The raffinate contains most of the olefins and only trace amount of sulfur compounds (caustic treatment is not necessary). Column C-201 will be reboiled with E-204 and will be operated under a slightly positive overhead pressure.

Rich solvent containing solvent, aromatics and sulfur compounds will be withdrawn from the bottom of C-201 and fed to the solvent recovery column C-202. The hydrocarbon will be separated from the solvent producing a lean solvent in the bottom of the column for recycling to ED column C-201. The C-202 column will be operated under moderate vacuum conditions to minimize the bottom temperature of the column. Furthermore, stripping steam originating from the system water balance and inventory will be injected into the base of the column to assist in the stripping operation. The column overhead vapor will be condensed in E-206 and a part of this will be used as reflux while the rest, the extract product will be directed to a HDS unit to produce desulfurized gasoline.

Water collected in the overhead of Column C-201 and Column C-202 will be removed from D-201 and D-202 and sent to the water wash column (with only a few trays), C-204. A small part of the lean solvent from the bottom of C-202 will be sent to C-204 to contact with water countercurrently to extract the solvent components, leaving the heavy hydrocarbon and sulfur components in the raffinate phase to be purged periodically from the top of C-204. The extract phase containing water and a small amount of solvent components, will be pumped from the bottom of C-204. Normally, this stream will be recycled to the bottom of C-202 to generate stripping steam. When necessary, a small portion of the stream will be fed to a small solvent regenerator, C-203, through heat exchanger, E-209. The solvent components are stripped in C-203 under proper vacuum and temperature, and are recycled to the bottom of C-202.

The heavy solvent residuals will be purged periodically from the bottom of C-203.

Lean solvent from solvent recovery column will be sent to a series of heat exchangers to recover heat before being sent to the extractive distillation column.

Optionally, the operating conditions of Column C-202, such as column pressure, reboiler temperature, and amount of steam stripping can be adjusted to allow certain amount of heavy sulfurs to stay in the lean solvent. Heavy sulfurs in the lean solvent should enhance the lean solvent performance in Column C-201.

The results of the process simulation shown in FIG. 2 based on the above conditions are summarized in Table 8.

TABLE 8

| | Sulfur (wt %) | Paraffins (wt %) | Iso-paraffins (wt %) | Olefins (wt %) | Naphthenes (wt %) | Aromatics (wt %) |
|---|---|---|---|---|---|---|
| Feed (100%) | 0.09 | 5.17 | 28.54 | 25.35 | 11.82 | 26.02 |
| Raffinate (64%) | 0.01 | 5.92 | 42.03 | 42.43 | 9.59 | 0.02 |
| Extract (36%) | 0.24 | 6.13 | 0.84 | 2.76 | 16.3 | 73.71 |
| % Extracted | 96.0 | 42.68* | 1.06 | 3.5 | 49.64* | 100.0 |

*Higher % extracted due to significantly higher boiling fractions in the feed.

The simulation results shown in Table 8 confirm that the ED process extracts more than 96% of sulfur compounds and nearly all the aromatics, and rejects up to 99% olefins.

We claim:

1. A process to remove sulfur compounds from a gasoline stream containing olefins and sulfur compounds, comprising subjecting a gasoline stream to an extractive distillation process to concentrate the sulfur compounds in an extract stream and reject olefins to a raffinate stream, and subjecting only said extract stream to hydrodesulfurization to remove sulfur compounds, wherein said extractive distillation process comprises contacting said gasoline stream with an extractive distillation solvent which includes heavy sulfur residuals from FCC gasoline.

2. The process according to claim 1 wherein said gasoline stream comprises single and multi-ring aromatics, single and multi-ring naphthenes, olefins, paraffins, thiophenes, benzothiophenes, sulfides, disulfides, thiols, tetrahydrothiophenes, and dihydrobenzothiophenes, having boiling points ranging from about 50° C. to about 250° C.

3. A process according to claim 1 wherein said extractive distillation process comprises distillation with an extraction distillation solvent.

4. A process according to claim 3, further comprising selecting a solvent, co-solvent, reflux ratio, column pressure, operating temperature, feed location, product draw location, and contacting equipment such that a two-liquid phase region in said extractive distillation process is minimized.

5. A process according to claim 2, wherein the boiling points range between about 50° C. and about 220° C., and further comprising a prefractionation column to remove benzothiophenes and high molecular weight sulfur compounds from said gasoline stream.

6. A process according to claim 5, further comprising feeding an overhead stream from said prefractionation column to said extractive distillation process and feeding a fraction from said prefractionation column to a hydrodesulfurization process.

7. A process according to claim 3 wherein the extractive distillation solvent is selected from the group consisting of sulfolane, 3-methylsulfolane, 2,4-dimethylsulfolane, 3-ethylsulfolane, N-methyl pyrrolidone, 2-pyrrolidone, N-ethyl pyrrolidone, N-propyl pyrrolidone, N-formyl morpholine, dimethylsulfone, diethylsulfone, methylethylsulfone, dipropylsulfone, dibutylsulfone, tetraethylene glycol, triethylene glycol, dimethylene glycol, ethylene glycol, ethylene carbonate, propylene carbonate, and mixtures thereof.

8. The process according to claim 7, wherein the extractive distillation solvent comprises sulfolane combined with 3-methylsulfolane, N-formyl morpholine, 2-pyrrolidone, dipropylsulfone, tetraethylene glycol, water, heavy sulfur residuals from FCC gasoline, or mixtures thereof as a co-solvent.

9. A process to remove sulfur compounds from a gasoline stream containing olefins and sulfur compounds comprising subjecting a gasoline stream to an extractive distillation process to concentrate the sulfur compounds in an extract stream and reject olefins to a raffinate stream, operating said extractive distillation process such that a two-liquid phase region in said extractive distillation process is minimized, and subjecting only said extract stream to hydrodesulfurization to remove sulfur compounds, wherein the extractive distillation is conducted with an extractive distillation solvent comprising sulfolane and a co-solvent selected from the group consisting of with 3-methylsulfolane, N-formyl morpholine, 2-pyrrolidone, dipropylsulfone, tetraethylene glycol, water, heavy sulfur residuals from FCC gasoline, or mixtures thereof as a co-solvent, and wherein the extraction distillation solvent is stripped, and heavy sulfur residuals remain in a lean fraction of said solvent after stripping, in an amount effective to enhance the solvent selectivity.

10. The process of claim 9, further comprising extracting a slip stream of said lean solvent with water to prevent a build up of said heavy sulfur residuals.

11. The process according to claim 1, further comprising combining the extract stream with the raffinate stream after said step of subjecting said extract stream to hydrodesulfurization.

12. The process according to claim 1, further comprising feeding a stream resulting from said extractive process to an aromatic purification unit or a reformate purification unit to produce benzene or full-range aromatics.

13. The process according to claim 12, wherein said aromatic purification unit is part of an ethylene plant.

14. The process according to claim 1, wherein said gasoline stream is provided from a fluid catalytic cracking reactor.

15. The process according to claim 14, wherein the raffinate stream is recycled to the fluid catalytic cracking reactor.

16. The process according to claim 14, wherein said raffinate stream is fed to a unit that converts the olefins into lower molecular weight olefins.

17. The process according to claim 16, wherein said unit converts the olefins in said raffinate stream to $C_2$–$C_6$ olefins.

18. The process according to claim 1 wherein the gasoline stream is from a fluid catalytic cracking unit, a coker naphtha source, a thermal cracked or steam cracked source.

19. The process of claim 1, further comprising extracting a slip stream of said lean solvent with water to prevent a build up of said heavy sulfur residuals.

* * * * *